US006912987B2

(12) United States Patent
Tachibana et al.

(10) Patent No.: US 6,912,987 B2
(45) Date of Patent: Jul. 5, 2005

(54) DRYSUMP LUBRICATION TYPE ENGINE

(75) Inventors: Fusao Tachibana, Tokyo (JP); Kentaro Hirota, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 63 days.

(21) Appl. No.: 10/401,290

(22) Filed: Mar. 27, 2003

(65) Prior Publication Data

US 2003/0183189 A1 Oct. 2, 2003

(30) Foreign Application Priority Data

Mar. 29, 2002 (JP) ..... 2002-095465

(51) Int. Cl.[7] ..... F02B 77/00; F01M 1/00

(52) U.S. Cl. ..... 123/198 R; 123/41.47; 123/198 C; 123/196 R

(58) Field of Search ..... 123/41.47, 196 R, 123/198 R, 198 C

(56) References Cited

U.S. PATENT DOCUMENTS

2001/0054397 A1 * 12/2001 Hare ..... 123/65 PE

FOREIGN PATENT DOCUMENTS

| | | |
|---|---|---|
| JP | 11-81950 | 3/1999 |
| JP | 2001-140618 | 5/2001 |

* cited by examiner

*Primary Examiner*—Noah P. Kamen
(74) *Attorney, Agent, or Firm*—Smith, Gambrell & Russell, LLP

(57) ABSTRACT

A drysump lubrication type engine is integrally connected at a crankcase thereof with an oil tank. A magnet coil coaxially mounted on an extension line of a crankshaft is covered by the oil tank and accommodated between the oil tank and the engine.

6 Claims, 5 Drawing Sheets

DRYSUMP LUBRICATION TYPE ENGINE

BACKGROUND OF THE INVENTION

1. Field of the Invention

The present invention relates to a drysump lubrication type internal combustion engine and more particularly to a drysump lubrication type engine in which engine accessories such as a magnet coil, an oil pump and the like are disposed on an extended line from a crankshaft of the engine.

2. Discussion of Related Art Japanese Patent Application Laid-open No. Toku-Kai 2001-140618 discloses a drysump lubrication type engine mounted on a small boat. The engine has a crankshaft arranged in a longitudinal direction of the boat and an oil tank disposed in front of the engine. A magnet coil is disposed on a front extension line of the crankshaft. A rotor of the magnet coil is secured to an end portion of the crankshaft and a stator is fixed to a front cover of the engine.

Further, Japanese Patent Application Laid-open No. Toku-Kai-Hei 11-81950 discloses a drysump lubrication type engine mounted on a small boat. The engine is longitudinally mounted on the boat and an oil tank is disposed in parallel with a crankshaft on a lateral side of the engine.

In case of the engine disclosed in Toku-Kai 2001-140618, since the oil tank is disposed separately from the engine, piping works for connecting pipes between the engine and the oil tank must be done after the oil tank is installed.

Further, in case of the drysump lubrication type engine disclosed in Toku-Kai-Hei 11-81950, engine accessories, an oil pump, a magnet coil and the like, are disposed on a front or rear extension line of the crankshaft.

Accordingly, in order to protect those engine accessories, it is necessary to attach a protection cover to the engine. As a result, an increased number of components and intricate installation works make a cost reduction more difficult.

SUMMARY OF THE INVENTION

It is an object of the present invention to provide a drysump lubrication type engine having a simple construction and capable of easily installing components and assembling the engine.

DESCRIPTION OF THE PREFERRED EMBODIMENT

Figure 1:
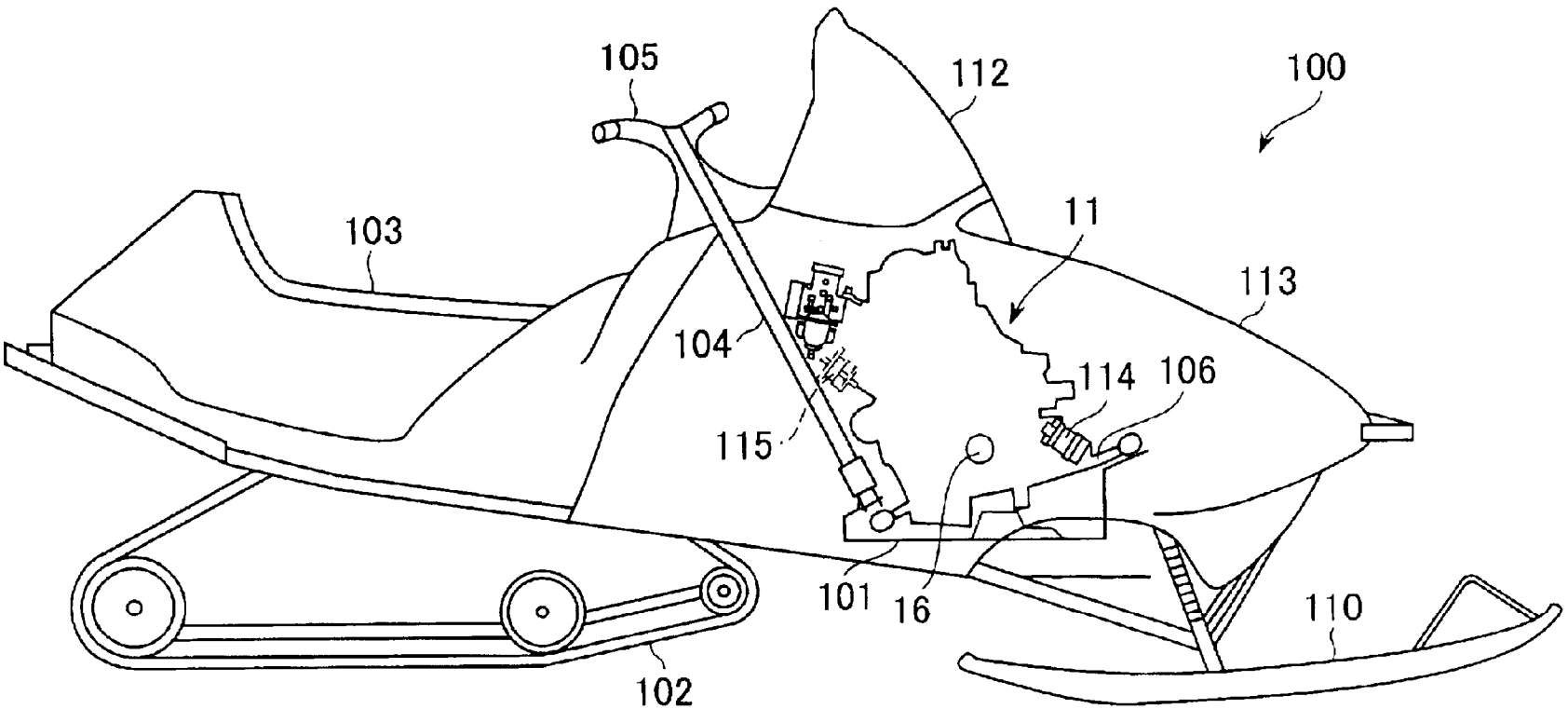
FIG. 1 is a side view showing a snowmobile according to an embodiment of the present invention.
Figure 2:
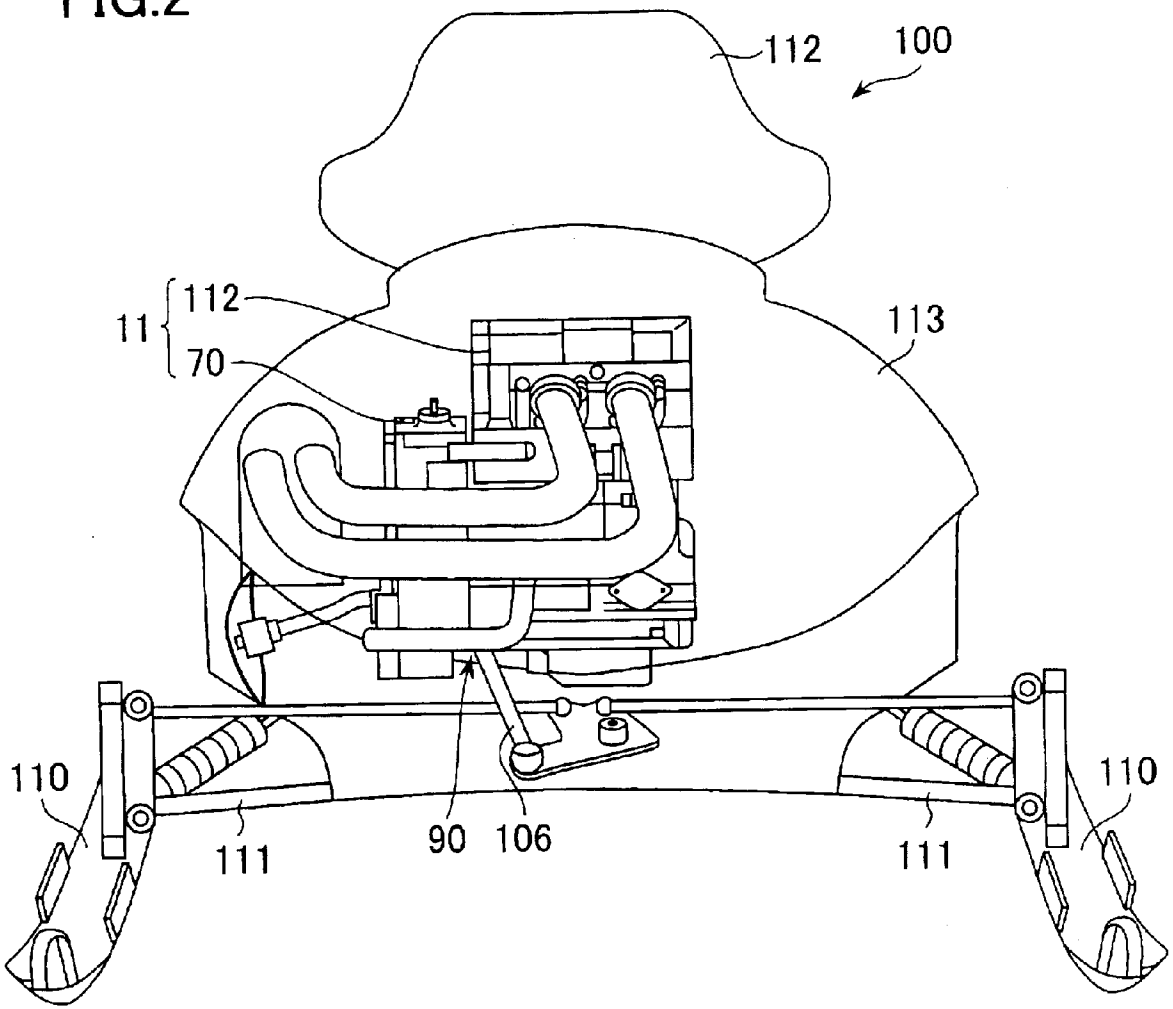
FIG. 2 is a front view showing the snowmobile of FIG. 1.
Figure 3:
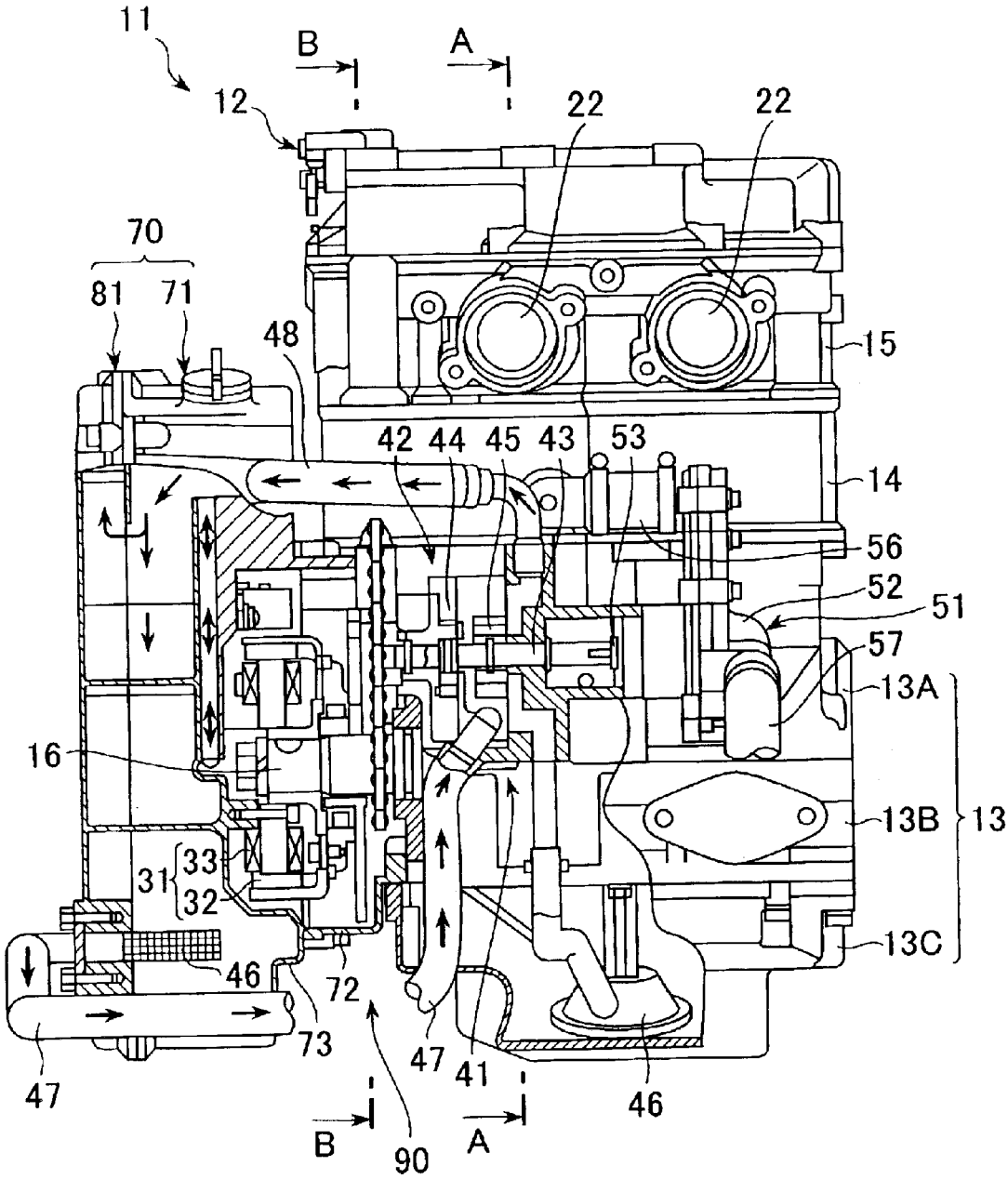
FIG. 3 is a front view of the engine installed on the snowmobile.

Referring now to FIG. 1, a snowmobile 100 has a frame 101 extending in a lengthwise direction of the snowmobile 100, an engine 11, a track belt 102 driven by the engine 11 and a saddle type driver's seat 103 installed on the rear part of the frame 101.

A steering shaft 104 is rotatably supported by the central part of the frame 101 at a forwardly inclining angle. The steering shaft 104 is connected at an upper end thereof with a steering handle 105 and is connected at a lower end thereof with a link rod 106 which is interlocked with a left and right paired steering skies 110.

The steering skies 110 are rotatably supported by an outer end of a pair of swing arms 111 extending from the central body to left and right, respectively. When the steering handle 105 is operated, the steering skies 110 can be swung to left and right.

There is provided a windshield 112 in front of the steering handle 105. Further, a front cover 113 having a streamlining configuration forwardly descending from the lower end of the windshield 112, is attached to the frame 101. An engine room is formed in the front cover 113 and the engine 11 is accommodated therein.

The engine 11 has a crankshaft 16 extending in a widthwise direction of the vehicle, that is, the engine 11 is transversely mounted on the frame 101. Intake air is introduced from the rear side of the engine 11 and exhaust gas is discharged from the front side of the engine 11. Engine mounts 114, 115 having cushion rubber are attached to a front lower and rear upper parts of the engine 11, respectively and the engine 11 is supported by the frame 101 in a rearwardly slanted position.

The engine 11 is a water cooled two-cylinder four-cycle drysump lubrication type engine in which an oil tank 70 is disposed separately from a base engin 12. Lubrication oil is fed from the oil tank 70 to sliding parts of the base engine 12.

The base engine 12 is constituted by a crankcase 13, a cylinder block 14 and a cylinder head 15. The crankcase 13 has an upper crankcase 13A integrally formed under the cylinder block 14, a lower crankcase 13B installed under the upper crankcase 13A for rotatably supporting a crankshaft 16 in cooperation with the upper crankcase 13A, and an oil reservoir 13C installed under the lower crankcase 13B for temporarily reserving lubrication oil.

The cylinder block 14 is formed on the crankcase 13 and has a block configuration laterally extending along the crankshaft 16 and a cylinder bore 18.

The cylinder head 15 mounted on the cylinder block 14 has a combustion chamber dome 19 for forming a combustion chamber in cooperation with a piston 17 inserted in the cylinder bore 18 on the undersurface of the cylinder head 15. An intake port 21 is provided at the rear of the cylinder head 15 and an exhaust port 22 is provided at the front of the cylinder head 15. Further, a valve train chamber 24 is provided on the cylinder head 15 and accommodates a valve train 23 for opening and closing the intake port 21 and the exhaust port 22 at specified timings. Further, a cam shaft extending in parallel with the crankshaft 16 is rotatably supported by the valve train chamber 24.

Since the base engine 12 is slanted rearwardly, the intake port 21 can be horizontally extended from the combustion chamber dome 19 towards the rear of the vehicle, intake loss of the engine 11 can be reduced and a good throttle response can be obtained. Further, since the intake port 21 is arranged horizontally, a carburetor 35 upstream of the intake port 21 can be disposed horizontally and as a result the static level of fuel in a float chamber of the carburetor 35 can be held in a horizontal position.

An oil pump 41 and a water pump 51 are provided side by side in front of the base engine 12. The oil pump 41 is constituted by an oil pump housing 42 mounted in a front part of the upper crankcase 13A, an oil pump shaft 43 rotatably supported by the oil pump housing 42, a feed pump 44 for feeding lubrication oil in the oil tank 70 to the base engine 12 and a scavenging pump 45 for sucking lubrication oil reserved in the oil reservoir 13C through an oil strainer 46 and returning it to the oil tank 70.

Figure 4:
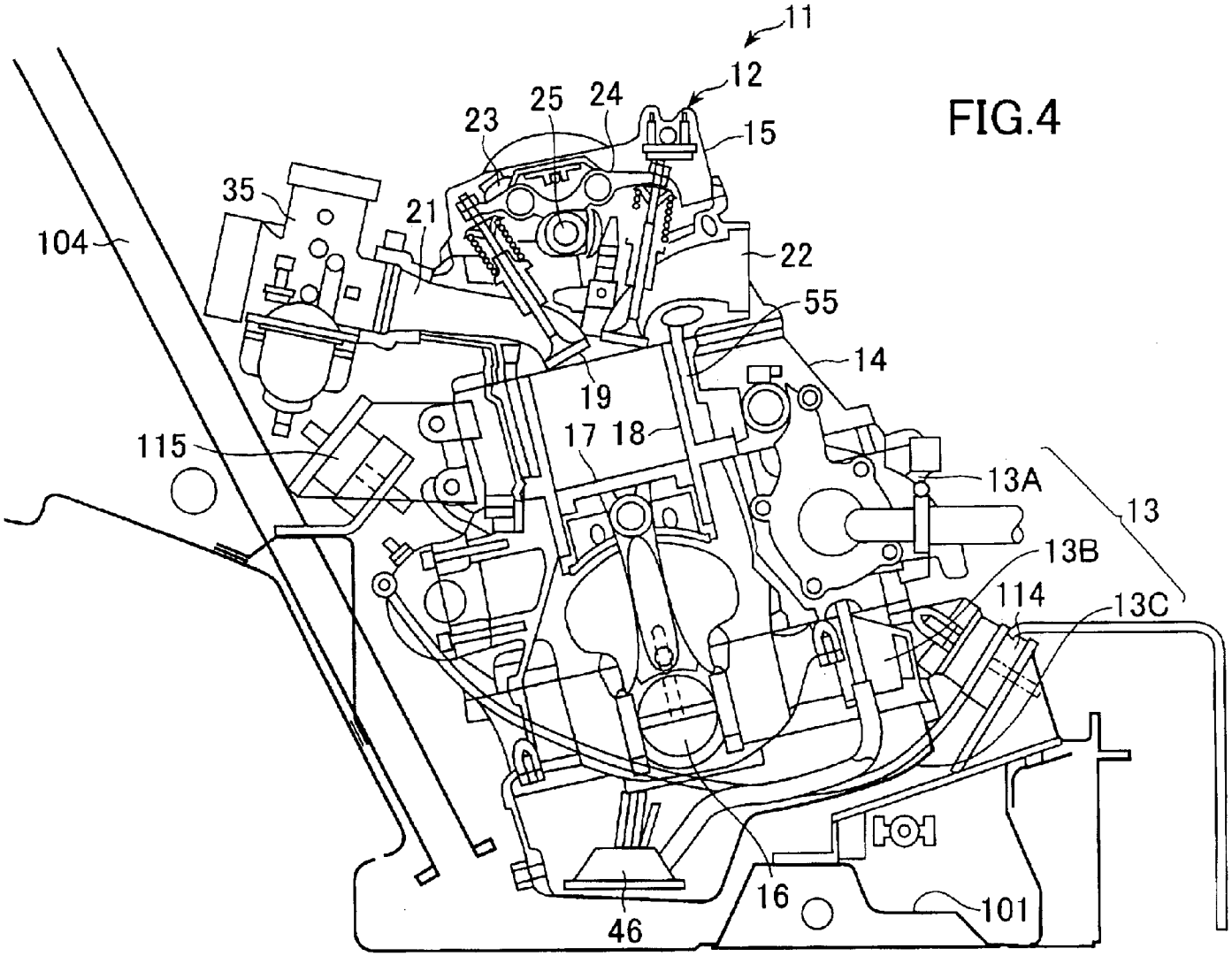
FIG. 4 is a sectional view taken along a line A—A of FIG. 3 when viewed in an arrow direction.

The water pump 51 has a water pump housing 52 formed in a front part of the upper crankcase 13A and a water pump shaft 53 extending coaxially with the oil pump shaft 43 and rotatably supported by the water pump housing 52. Further, in the water pump housing 52, an impeller (not show) is fixed to an end of the water pump shaft 53 in order to charging cooling water by rotation. The water pump housing 52 is connected to a cooling water passage 56 communicating with water jackets 55 (refer to FIG. 4) formed in the cylinder block 14 and the cylinder head 15 and a radiator hose 57. The oil pump shaft 43 is coaxially coupled with the water pump shaft 53 through a dog joint.

Figure 5:
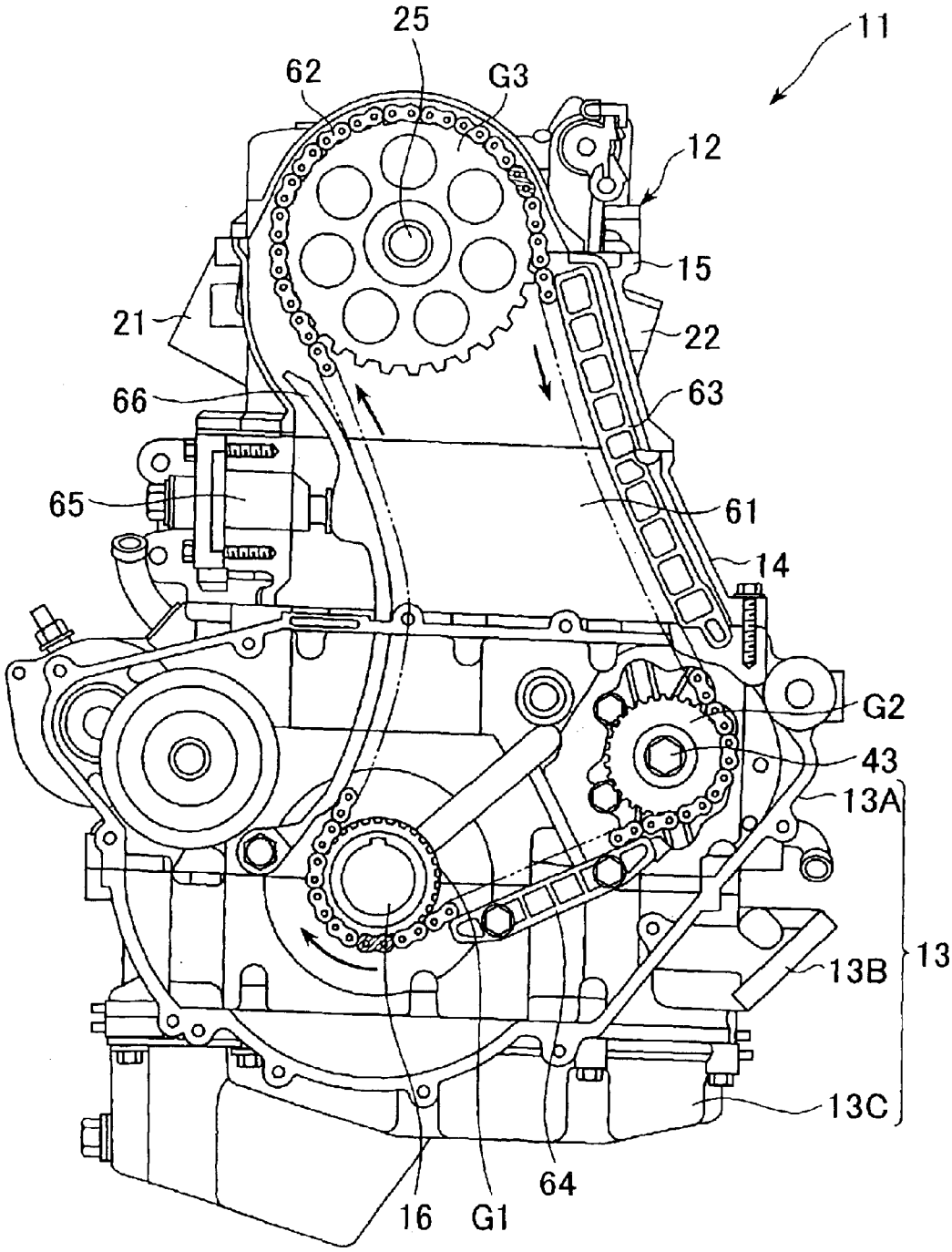
FIG. 5 is a sectional view taken along a line B—B of FIG. 3 when viewed in an arrow direction.

Referring to FIG. 5, a chain chamber 61 is vertically provided with the base engine 12 over the entire length between the crankcase 13 and the cylinder head 15. In the chain chamber 61, a crank sprocket G1 secured to the crankshaft 16, an oil pump sprocket G2 secured to the oil pump shaft 25 and a cam sprocket G3 secured to the cam shaft 25, are arranged on the same plane and a drive chain 62 is looped over these sprockets G1, G2, G3.

A first chain guide 63 is attached between the cam sprocket G3 and the oil pump sprocket G2 to guide the drive chain 62 and a second chain guide 64 is attached between the oil pump sprocket G2 and the crank sprocket G1 to guide the drive chain 62. Further, a chain tension adjuster 65 having a chain tension adjuster lever 66 to be forced against the drive chain 62 is swingably provided between the crank sprocket G1 and the cam sprocket G3.

Thus, the cam shaft 25 and the oil pump shaft 43 are rotated by the rotation of the crankshaft 16. When the oil pump shaft 43 rotates, the feed pump 44 feeds lubrication oil to the respective sliding parts of the base engine 12 and the scavenging pump 45 sucks lubrication oil reserved in the oil reservoir 13C through the oil strainer 46 to return the lubrication oil to the oil tank 70. Further, when the oil pump shaft 43 rotates, also the water pump shaft 53 rotates to supply cooling water to the water jacket 55 for cooling the base engine 12.

A magnet coil 31 is disposed on an extended line from the crankshaft 16 on the right side of the vehicle. The magnet coil 31 belongs to a so-called outer rotor type in which a rotor 32 rotates around the outer periphery of a stator 33. The rotor 32 is rigidly connected with an end of the crankshaft 16 and the stator 33 is fixed to the oil tank 70.

The oil tank 70 has a box-like configuration vertically extending along the lateral side of the base engine 12. The oil tank 70 comprises a tank base body 71 secured to the lateral side of the base engin 12 and a tank cover 81 forming a closed space to accommodate lubrication oil therein in cooperation with the tank base body 71.

When the tank base body 71 is installed on the base engine 12, the tank base body 71 is designed so as to close the opening of the chain chamber 61 extending from the upper crankcase 13A and to the lower crankcase 13B. At the same time, the tank base body 71 forms a box-like engine flange section 72 for accommodating the magnet coil 31 in the space between the flange section 72 and the base engine 12. Further, the tank base body 71 has a tank cover flange section 73 having an opening on one side and which is opposite at the upper portion thereof to the cylinder block 14 and is opposite at the lower portion thereof to the oil reservoir 13C. The tank cover flange section 73 has a box-like configuration extending vertically with the opening on one side. The tank cover flange section 73 is connected at the upper and rear position thereof with a breather passage (not shown) for guiding blow-by gas to the engine intake system of the engine. Further, the tank cover flange section 73 is connected at the upper and front position thereof with a collection hose 48 for collecting the lubrication oil sucked from the oil reservoir 13C into the oil tank 70.

The tank cover 81 has a lid like configuration for opening and closing the tank cover flange section 73 of the tank base body 73 and is connected at the lower part thereof with a supply hose 47 for supplying the lubrication oil in the oil tank 70 to the base engine 12 by the feed pump 44.

Further, a hollow cut section 90 extending in a longitudinal direction of the vehicle is formed between the oil reservoir 13C of the crankcase 13 and the oil tank base body 71 of the oil tank 70 to pass the link rod 106 therethrough. Further, a radiator hose, wiring cables and the like pass through the hollow cut section 90.

According to thus constituted engine 11, the magnet coil 31 is covered by the oil tank 70 attached to the base engine 12 and accommodated between the oil tank 70 and the base engine 12. Accordingly, a dedicated magnet cover for covering the magnet coil 31 is unnecessary. As a result, the number of components can be reduced and assembly works can be simplified.

Further, since the oil tank 70 is integrally connected with the base engine 12, the engine 11 can be assembled as a unit beforehand. Compared to a convential engine having a separate oil tank, the installation work of the engine 11 to the frame 101 is easier. Further, the piping work between the base engine 12 and the oil tank 70 can be simplified.

Since the rotor 32 of the magnet coil 31 is coaxially mounted on the crank shaft and the stator 33 is fixed to the oil tank 70 and held by the oil tank 70, it is unnecessary to provide a stay for fixing the stator 33 on the base engine 12 and as a result the construction of the engine can be further simplified.

In this embodiment, the magnet coil is exemplified of the engine accessory, however other engine accessories such as an oil pump, a water pump and the like may be replaced with the magnet coil.

The entire contents of Japanese Patent Application No. Tokugan 2002-095465 filed Mar. 29, 2002, is incorporated herein by reference.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments which can be embodied without departing from the principle of the invention set out in the appended claims.

What is claimed is:

1. A drysump lubrication engine for a vehicle, comprising:

a base engine and an oil tank;

said base engine including:

a crankshaft provided in a widthwise direction of said vehicle, and a magnetic coil as an engine accessory coaxially arranged with an extended line from said crankshaft;

said oil tank being distally mounted to said base engine by an intervening support thereby forming a space in which said magnetic coil can be secured.

2. A snow mobile having the dry sump lubrication engine of claim 1.

3. A drysump lubrication engine for a vehicle, comprising:

a base engine and an oil tank;

said base engine including:

a crankshaft provided in a widthwise direction of said vehicle; and a water pump as an engine accessory arranged with an extended line from said crankshaft;

said oil tank being distally mounted to said base engine by an intervening support thereby forming a space in which said water pump can be secured.

4. A snow mobile having the dry sump lubrication engine of claim 3.

5. A drysump lubrication engine for a vehicle, comprising:

a base engine, and an oil tank;

said base engine including:

a crankshaft provided in a widthwise direction of said vehicle, and an oil pump as an engine accessory arranged with an extended line from said crankshaft;

said oil tank being distally mounted to said base engine by an intervening support thereby forming a space in which said oil pump can be secured.

6. A snow mobile having the dry sump lubrication engine of claim 5.

* * * * *